United States Patent [19]

Navarro

[11] Patent Number: 4,844,109

[45] Date of Patent: Jul. 4, 1989

[54] MOTOR VEHICLE SHELTER

[76] Inventor: Pablo Navarro, 105 Alder Ave., Altamonte Springs, Fla. 32714

[21] Appl. No.: 170,933

[22] Filed: Mar. 21, 1988

[51] Int. Cl.[4] ..... E04H 15/00

[52] U.S. Cl. ..... 135/103; 135/110; 52/109

[58] Field of Search ..... 135/103, 110, 101, 102, 135/106; 52/109

[56] References Cited

U.S. PATENT DOCUMENTS

| | | | |
|---|---|---|---|
| 268,240 | 11/1882 | Jones | 135/110 |
| 686,458 | 11/1901 | Johnson | 52/109 |
| 967,116 | 8/1910 | Dupuis | 52/109 |
| 1,018,338 | 2/1912 | Pines | 52/109 |
| 1,257,535 | 2/1918 | Sampson | 135/110 |
| 2,486,170 | 10/1949 | Kavanaugh | 135/103 |
| 3,074,079 | 1/1963 | Isaacson | 135/110 X |
| 3,216,433 | 11/1965 | D'Azzo | 135/110 |
| 3,424,179 | 1/1969 | Minot | 135/103 |
| 3,638,376 | 2/1972 | Howes et al. | 52/109 |
| 3,644,952 | 2/1972 | Hatch | 135/103 X |
| 4,150,682 | 4/1979 | Ryce | 135/103 |
| 4,667,692 | 5/1987 | Tury et al. | 52/109 |

FOREIGN PATENT DOCUMENTS

| | | | |
|---|---|---|---|
| 2750417 | 5/1979 | Fed. Rep. of Germany | 135/103 |

*Primary Examiner*—Henry E. Raduazo
*Assistant Examiner*—Caroline D. Dennison
*Attorney, Agent, or Firm*—Macdonald J. Wiggins

[57] ABSTRACT

An extendible and retractable shelter for a vehicle has a plurality of bows slidable along a pair of ground mounted tracks from an extended position to a retracted position. A flexible canvas or plastic covering is attached to the bows when extended and collapses in accordion fashion when retracted. A lazy tongs mechanism is attached to the interior faces of the bows and are loaded by tension springs. The bows are retracted by a cable and winch system, placing the springs under tension and locked by a ratchet lock. When the lock is released, the tension springs return the bows to the extended position.

8 Claims, 3 Drawing Sheets

MOTOR VEHICLE SHELTER

BACKGROUND OF THE INVENTION

1. Field of the Invention

The present invention relates to motor vehicle shelters and more particularly to extendible and retractable shelters.

2. Description of the Prior Art

Apartment and condominium complexes commonly provide paved uncovered parking facilities for residents. Thus, automobiles and the like must be left exposed to the elements. Due to the narrow spaces allocated for each vehicle, it is not practical to provide fixed shelters since the vehicle doors could not be opened in the shelter. A shelter which can be extended after the vehicle is parked and retracted when the vehicle is to be used will solve the problem without requiring additional parking area.

One attempt to provide such a shelter is disclosed in U.S. Pat. No. 4,150,682 to Ryce. An extendible and retractable shelter is shown having arched ribs attached to ground-contacting skids, and a flexible cover. A winch causes the ribs to slide along the ground to extend the shelter and to retract the shelter into an enclosure. Using the shelter requires considerable time and effort to extend and retract. Further, anchoring during winds is dependent only on the weight of the extended structure. A portable garage is taught by Teeter in U.S. Pat. No. 2,817,344 utilizing an extensive cable system for opening and closing. A retractable cover for truck bodies is shown in Fowler, U.S. Pat. No. 2,469,958.

None of these prior art references are entirely suitable for the above discussed requirement.

SUMMARY OF THE INVENTION

The present invention is a retractable and extendible shelter for automobile vehicles and the like. A plurality of spaced apart arched bows is provided, each having vertical uprights and an essentially horizontal spanning element. A roller is attached to each lower upright end. A pair of tracks is provided upon which the rollers rest. The uprights include means for captivating the uprights with respect to the tracks.

A set of scissor-type arms commonly referred to as a lazy tongs mechanism is disposed along and between the uprights which permit the bows to be collapsed together and fully extended. A pair of ground posts at the rear end of the set of bows is provided with a winch drum on each post. The drums are connected together by a shaft. The shaft may be rotated by a hand crank or, alternatively, by an electric motor drive. A single cable on each drum extends along the bows and connects to the bow at the front end bow.

Each pair of lazy tong arms is spring loaded by a plurality of tension springs which tend to extend the arms to force the bows apart. When the winch drum is operated, the cables draw the front end bow toward the rear end, pulling the bows together. The tension springs are placed under tension by this action as the lazy tongs tend to close. When the bows are fully retracted, the drum drive is locked. When the lock is released, the springs provide power to open or extend the lazy tongs, causing the bows to fully extend.

A canvas, plastic or other weatherproof flexible covering is provided which covers the bows when fully extended. Loops attached to the inside walls of the covering may be used to attach the covering to the bows. When the bows are retracted, the covering compresses in accordion fashion. The rear end of the shelter preferably includes a closing flap of the same material as the covering. A removable flap may be provided at the front end of the shelter to close the shelter after extending.

In operation, the shelter is normally in the retracted condition when not in use. A user drives a vehicle into the space defined by the retracted bows, exits the vehicle, and releases the drum locks. The spring loaded lazy tong arms cause the bows to automatically extend along the tracks to the fully extended position. The front flap may then be placed in position to close the front end of the shelter.

When the vehicle is to be used, the operator opens the front flap and fully retracts the bows by the hand crank or motor drive, as the case may be. The cable drums are locked by a ratchet mechanism. The retracted bows permit the vehicle door to be opened for access to the vehicle.

As will now be recognized, the shelter may be compact with relatively small side and top clearance for the vehicle to be sheltered since the vehicle is always entered and exited with the shelter collapsed. The shelter may be installed either temporarily or permanently by attaching the rails to the ground with stakes or with concrete anchoring devices.

It is therefore a principal object of the invention to provide a compact, low cost shelter for a vehicle or the like that may be collapsed when not in use and extended for use.

It is another object of the invention to provide a portable shelter having spring loaded lazy tong arms which are placed under tension when the shelter is collapsed for producing power to extend the shelter.

It is still another object of the invention to provide a vehicle shelter having minimum clearance along the sides and top of a vehicle stored therein.

It is yet another object of the invention to provide an extendible and retractable vehicle shelter which is anchored to the ground against wind and which can be retracted manually or by an electric motor.

These and other objects and advantages of the invention will become apparent from the following detailed description when read in conjunction with the drawings.

DETAILED DESCRIPTION OF THE PREFERRED EMBODIMENT

Figure 1:
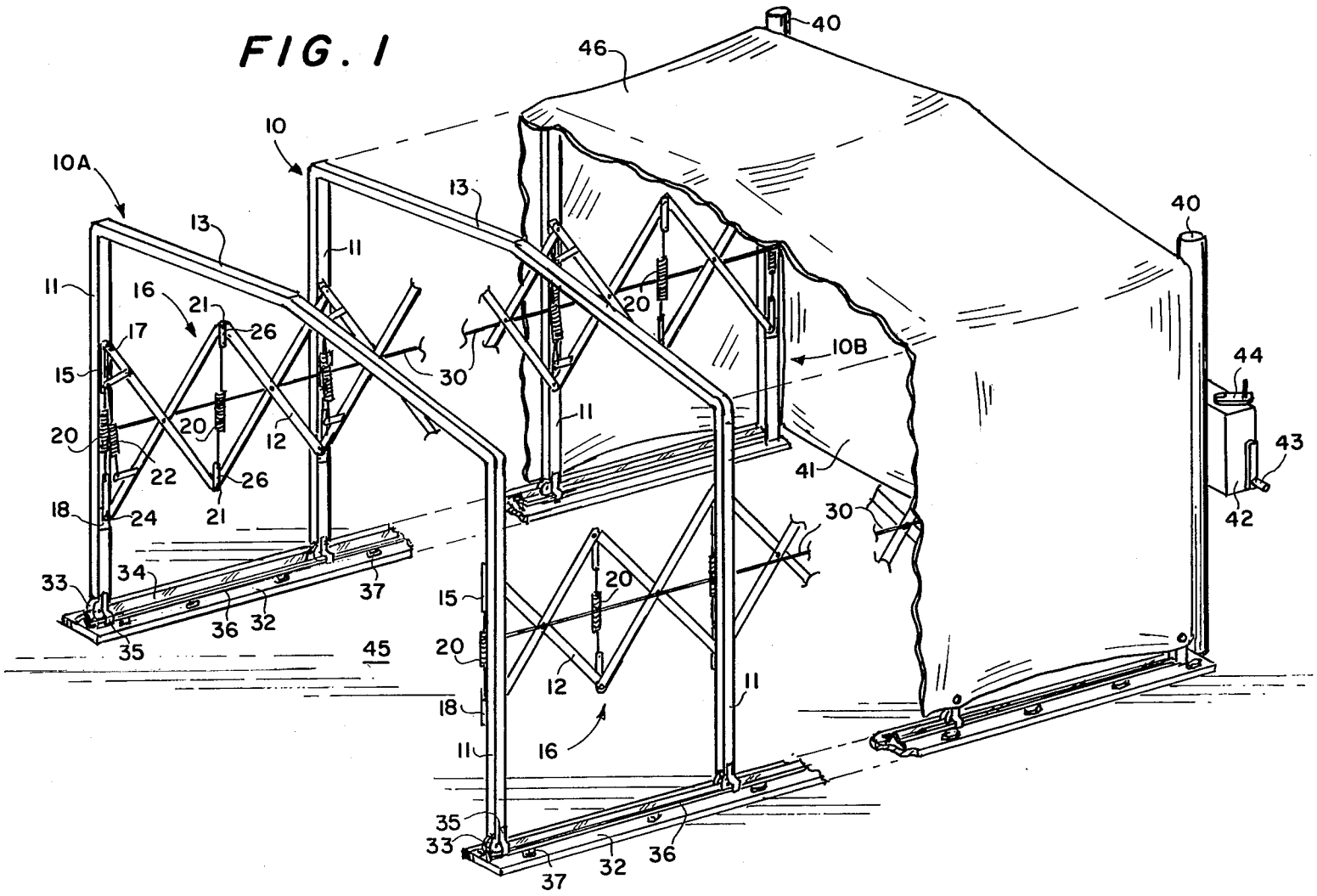
FIG. 1 is a partial perspective view of a shelter in accordance with the invention.

In FIG. 1, a perspective view of a retractable and extendible shelter in accordance with the invention is shown in which a covering 42 is cut away over a rear part, and a front part has the covering 42 removed therefrom to show the construction thereof. The central part of the shelter is omitted for clarity. A plurality of bows 10, each having two upright portions 11 and a slightly peaked spanning portion 13, is provided. Bows 10 are preferably formed from steel tubing which may be square or round. Each upright portion 11 includes a roller 33 at the bottom end thereof which rides on a track 34 attached to a base 32. Each base 32 is attached to the ground 45. Where the shelter is installed on a paved area, lag bolts 37, as shown in FIG. 4, may be used to anchor base 32 or stakes may be used for installation in soil.

Figure 4:
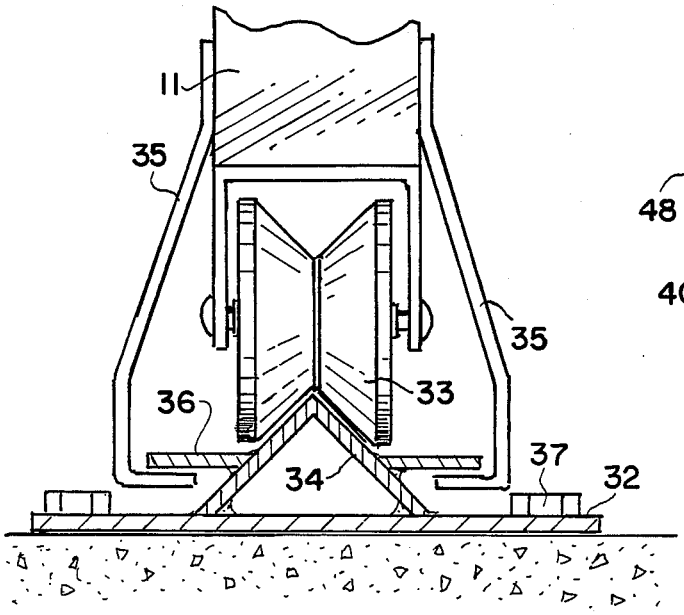
FIG. 4 is a cross sectional view of the track of FIG. 1 showing the roller construction used therewith.

As may be noted from FIG. 4, each roller 33 is attached to an upright 11 by bracket 31, and rides on rail 34 which includes a pair of horizontal anchor strips 36. A pair of anchor clips 35 is welded to upright 11 and each engages anchor strip 36 to captivate bow 10.

Figure 2:
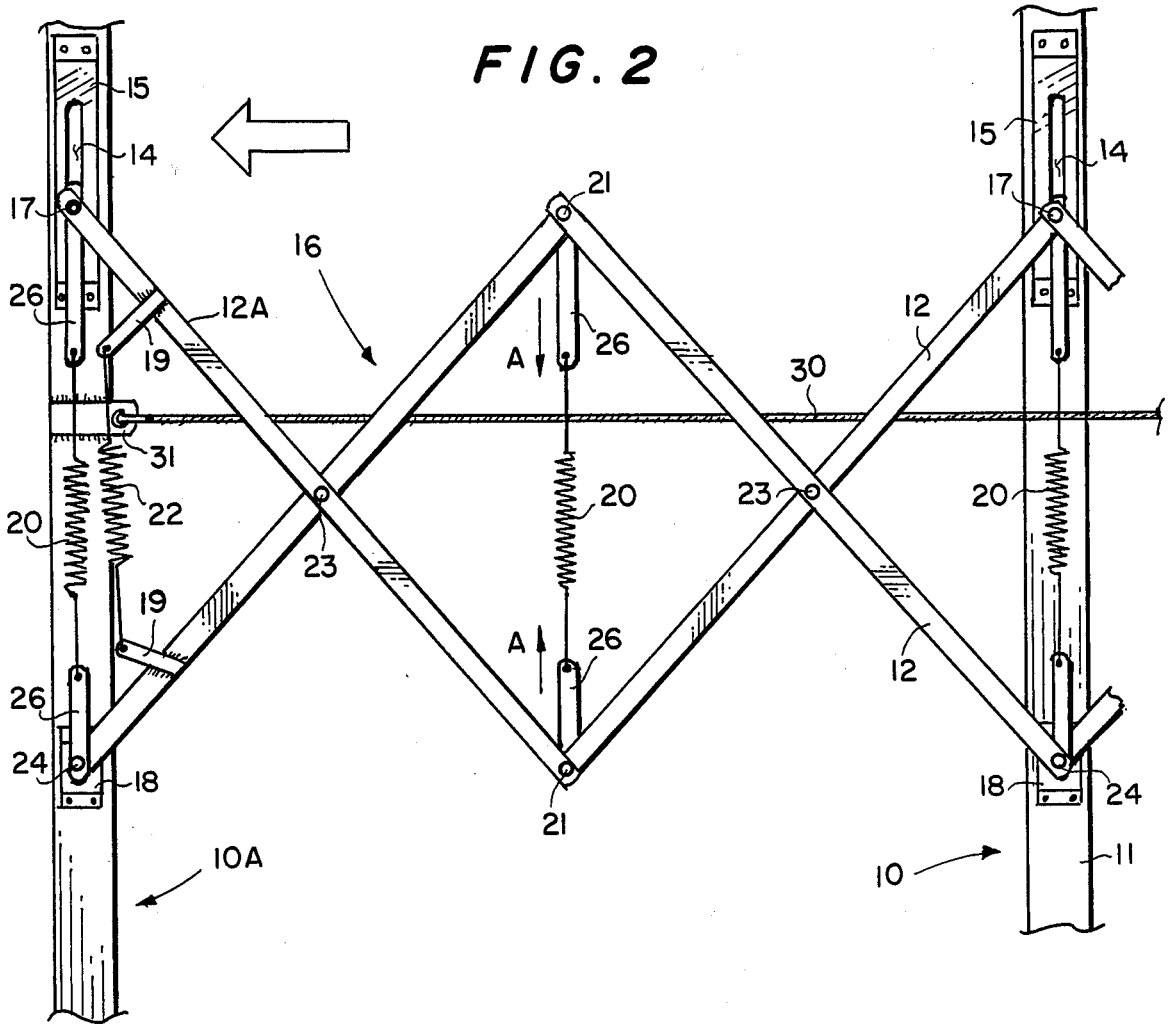
FIG. 2 is a view of a part of a lazy tongs mechanism of the shelter of FIG. 1 in an open portion with springs relaxed.
Figure 5:
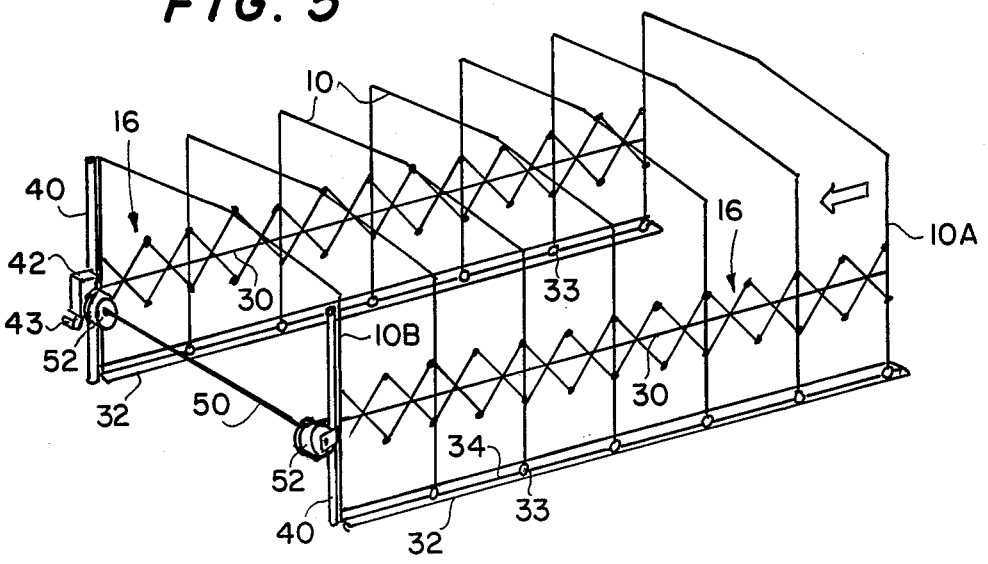
FIG. 5 is a schematic diagram of the frame construction of the shelter of FIG. 1 with springs omitted for clarity.
Figure 3:
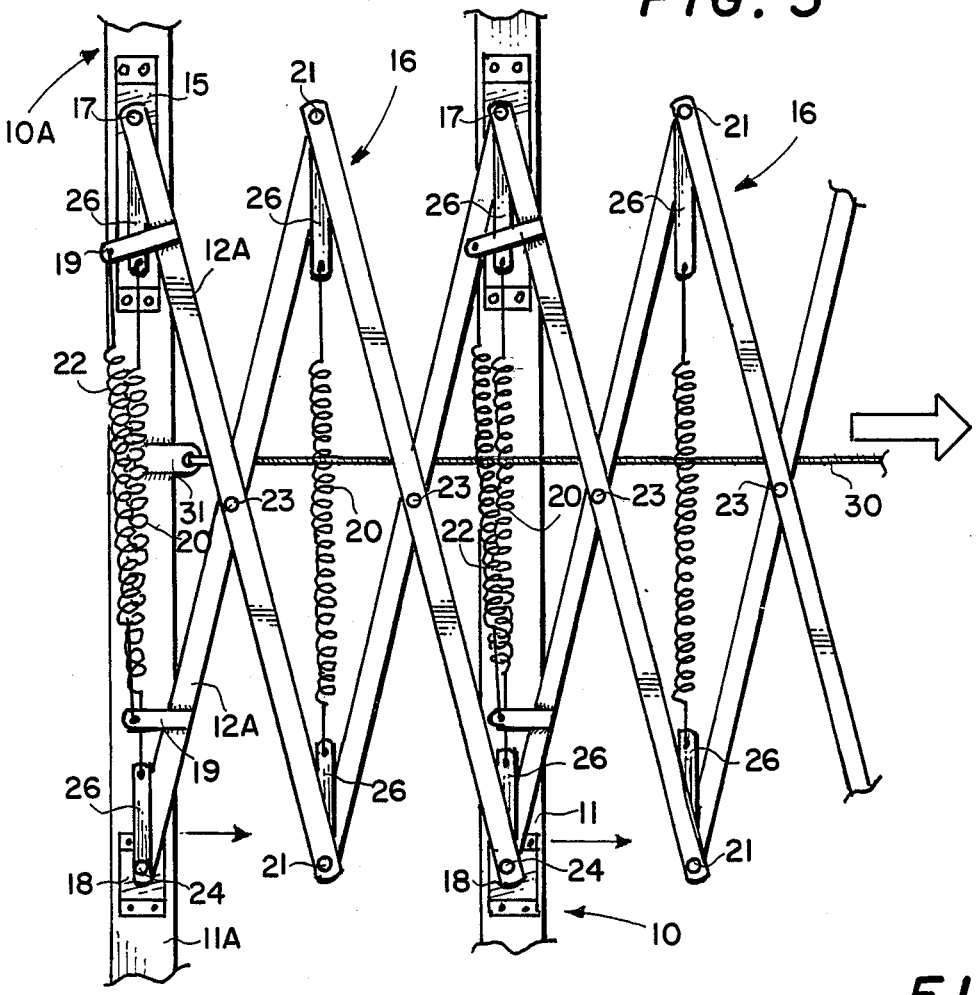
FIG. 3 is the mechanism of FIG. 2 in a partially closed position with springs in tension.

Bows 10 have the uprights 11 connected together by a lazy tongs mechanism 16 on either side of the shelter as best seen in the schematic diagram, FIG. 5, which shows the frame construction of the shelter. Details of lazy tongs mechanism 16 are shown in FIGS. 2 and 3. A bow upright 11A at the front end of the shelter and a second upright 11 are shown in these figures. Each upright 11 has an upper pin guide 15 attached to an inner face thereof. Each guide 15 includes a slot 14 in which slide pin 17 is free to slide. A lower anchor bracket 18 is attached to the inner face of each upright 11 for anchor bolt 24. Lazy tongs mechanism 16 includes pairs of link rods 12 pivoted at the center thereof by pin 23. Two pairs of pivoted link rods 12 are disposed between bow uprights 11 and connected together by pivot pins 21. The link rods 12, pivots 23 and 21, slide pins 17 and anchor bolts 24 form a set of linked equilateral parallelograms in which the angles of the vertically oriented apexes and of the horizontally oriented apexes are changed when bows 10 move along tracks 24. Guide pins 15 and anchor bolts 24 serves as pivots for the vertically oriented apexes. A tension spring 20 is connected by spring links 26 between each slide pin 11 and its opposing anchor bolt 24, and between each pair of pivot pins 21 in the vertically oriented apexes. Springs 20 bias lazy tongs 16 to an open portion as shown in FIGS. 1, 2 and 5 in the direction of the solid arrow of FIG. 2.

A plurality of starter tension springs 22 is required. As seen in FIGS. 2 and 3, spring brackets 19 are attached to link rods 12A at offset angles such that starter spring 22, when in tension, as in FIG. 3, produces a torque as will be discussed below. A starter spring 22 and brackets 19 are utilized at each upright 11. A flexible cable 30 is attached to bracket 31 of upright 11A. As seen from FIG. 5, cables 30 are drawn rearward by winch drums 52 operated by drive 52 in the direction indicated by arrow B. Winch drums 52 are coupled together by shaft 50. This operation of drums 52 draws bow 10A rearward toward rear bow 10B as indicated by the solid arrow of FIG. 3 and 5.

As lazy tongs mechanism 16 closes, as shown in FIG. 3, springs 20 and starter springs 22 are stretched and placed under tension. A ratchet lock 44, shown in FIG. 1, is engaged when bows 10 are completely retracted maintaining springs 20 and 22 in tension. Covering 46, which is a flexible, waterproof material such as canvas or plastic sheeting, covers the entire framework of the shelter and is attached to each bow 10. Covering 46 will collapse in accordion fashion when bows 10 are retracted.

In accordance with the invention, a major portion of the energy used in retracting bows 10 is stored in springs 20 and 22. When it is desired to extend the shelter, ratchet lock 44 is released. Starter springs 22 serve to provide a starting impetus to bring the extremities of each pair of link rods 12 together. As this action occurs, tension springs 20 continue the movement to fully extend the shelter.

Referring to FIG. 1, it may be noted that a pair of ground posts 40 is provided which may have the lower ends thereof anchored in the ground 45. Gear box 42, having handcrank 43 and ratchet lock lever 44, is attached to a post 40 and drives winch drums 52 and shaft 50, which are also supported by posts 40. Rear end bows 10B are attached to posts 40. A rear closure flap 41 may be provided.

Figure 6:
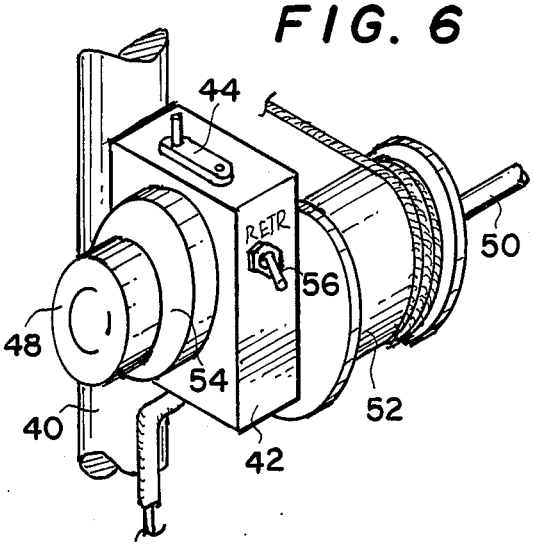
FIG. 6 is a perspective view of an alternative motor drive for the shelter of FIG. 1.

An alternative powered winch arrangement is shown in Figure 6 which may be used. An electric motor 48 is coupled to gear box 42 by slip clutch 54. When the user desires to retract an extended shelter, momentary contact switch 56 is held closed, operating motor 48, until bows 10 are retracted. Ratchet lock 44, which is associated with a ratchet element of gear box 42, will then hold the shelter retracted against springs 20 and 22. To extend the shelter, ratchet lock 44 is released. Winch drums 52 are decoupled from motor 48 by slip clutch 54, permitting springs 20 and 22 to extend lazy tongs mechanism 16.

The shelter of FIG. 1 is normally maintained in the closed or retracted position when not in use. To shelter an automobile or the like, the vehicle is driven into the retracted shelter with an end thereof adjacent rear curtain 41. The user exits the vehicle and releases lock 44. As previously described, springs 20 and 22 cause the bows 10 to fully extend. To access the vehicle, the user retracts bows 10 using crank 43. A front flap (not shown) may be provided which is rolled up when the shelter is retracted and released when the shelter is extended.

Although the invention has been described with reference to the preferred embodiment, it is to be understood that various modifications thereto may be made without departing from the spirit and scope of the invention.

I claim:

1. An extendible and retractable shelter for a vehicle comprising:

a pair of parallel tracks;

a front bow, a rear bow and a plurality of interior bows, each of said bows having a pair of substantially vertical portions and a spanning portion extending between upper ends of said vertical portions;

means for slidably connecting lower ends of said vertical portions to said tracks;

lazy tongs mechanisms extending from said front bow to said rear bow and attached to said interior bows, said mechanisms including a plurality of horizontally linked equilateral parallelograms, each parallelogram having a pair of vertically oriented pivoted apexes and being movable from an extended position to a retracted position to permit movement of said bows along said tracks;

spring means attached to said lazy tongs mechanisms for biasing said mechanism to said extended position;

means for starting movement of said bows from said retracted position, said starting means including a plurality of starter tension springs disposed between and adjacent selected ones of said pivoted apexes at an angle with respect to a vertical axis;

cable and winch means for moving said bows to said retracted position against the biasing action of said spring means; and flexible cover means attached to and covering said bows when in said extended position.

2. The shelter as defined in claim 1 in which said cable and winch means includes a handcrank and a ratchet lock.

3. The shelter as defined in claim 1 in which said cable and winch means includes a motor drive.

4. The shelter as defined in claim 3 in which said motor drive includes a slip clutch and ratchet lock.

5. The shelter as defined in claim 1 in which:

said lazy tongs mechanisms include a plurality of horizontally linked equilateral parallelograms, each parallelogram having a pair of vertically oriented pivoted apexes; and at least some of said apexes are adjacent said vertical portions of said bows and include pivot pins vertically slidable along said vertical portions.

6. The shelter as defined in claim 1 which further comprises a pair of ground posts adjacent and attached to said rear bow, said winch means is mounted to said ground posts.

7. The shelter as defined in claim 6 in which:

said cable and winch means includes:

shaft mounted between said ground posts and a pair of winch drums attached to said shaft; and each of said winch drums includes a cable having a first end attached to said drum and a second end attached to one of said vertical portions of said front bow.

8. An extendible and retractable shelter for a vehicle comprising:

(a) a rear bow having a horizontal portion and a pair of essentially vertical portions spaced apart a distance greater than the width of said vehicle;

(b) a pair of parallel tracks extending from lower ends of said rear bow vertical portions;

(c) a front bow and a plurality of interior bows, each having a horizontal portion and a pair of essentially vertical portions, the lower ends of said vertical portions slidably attached to said tracks;

(d) a pair of lazy tongs mechanisms, each having (i) a plurality of link rods pivotally connected to form a plurality of horizontally linked equilateral parallelograms, each having an upper vertically oriented apex and a lower vertically oriented apex;

(ii) slide pins forming pivots at said upper vertically oriented apex, (iii) a vertically oriented guide attached to each of said bow vertical portions, said guide having a vertical slot for engaging one of said slide pins, (iv) anchor bolts forming pivots for at least some of said vertically oriented apexes, said anchor bolts attached to respective ones of said vertical portions, (v) a plurality of tension springs having one of said springs disposed between each of said vertically oriented apexes, and (vi) starter tension springs disposed at an angle with respect to the vertical between at least some of said vertically oriented apexes;

(e) a winch assembly mounted adjacent said rear bow and having (i) a pair of cables, each connected to one of said front bow vertical portions, (ii) means for drawing said cables to move said front bow and said interior bows along said tracks from an extended position to a retracted position adjacent said rear bow, and to place said tension springs and said starter springs under tension; and (iii) locking means for maintaining said bows in said retracted position; and (f) flexible covering for covering said bows when in said extended position and attached thereto.

* * * * *